United States Patent [19]

Dicke et al.

[11] Patent Number: 4,886,232

[45] Date of Patent: Dec. 12, 1989

[54] DEFLECTABLE MOUNTING FOR UPRIGHT MAST

[76] Inventors: Grant D. Dicke, 1130 Franklin St., Downers Grove, Ill. 60515; Jeffrey A. Williams, 610 Preston St., Bolingbrook, Ill. 60439

[21] Appl. No.: 815,737

[22] Filed: Jan. 2, 1986

[51] Int. Cl.[4] ..... F16M 13/00

[52] U.S. Cl. ..... 248/576; 248/160; 404/10

[58] Field of Search ..... 248/597, 576, 575, 160, 248/624, 625, 60; 40/606, 607, 608; 404/10, 11

[56] References Cited

U.S. PATENT DOCUMENTS

| | | | |
|---|---|---|---|
| 623,008 | 4/1899 | Greb et al. | 248/597 X |
| 884,105 | 4/1908 | Ryerson et al. | 248/597 X |
| 1,532,865 | 4/1925 | Beck | 404/11 |
| 2,949,324 | 8/1960 | Birge et al. | 40/608 X |
| 3,662,482 | 5/1962 | Sarkisian | 40/607 X |
| 3,899,843 | 8/1975 | Doyle et al. | 40/602 |
| 4,038,769 | 8/1977 | Werner | 40/608 X |
| 4,309,836 | 1/1982 | Knapp | 40/602 |
| 4,365,435 | 12/1982 | Snyder | 40/608 |
| 4,537,233 | 8/1985 | Vroonland et al. | 248/575 X |

FOREIGN PATENT DOCUMENTS 1181967 6/1959 France .

*Primary Examiner*—Ramon S. Britts
*Assistant Examiner*—David M. Purol
*Attorney, Agent, or Firm*—Keil & Weinkauf

[57] ABSTRACT

An upright mast is affixed to a horizontal support which is pivotally mounted on a horizontal shaft seated in a mounting base whereby abutting resilient members, such as springs, concentric with the shaft separately resist pivotal deflection in opposite directions of said mast on its supporting base.

19 Claims, 2 Drawing Sheets

DEFLECTABLE MOUNTING FOR UPRIGHT MAST

BACKGROUND OF THE INVENTION AND PRIOR ART

This invention relates to an improved novel mounting structure for a deflectable upright mast affixed to a supporting base. More specifically, the invention relates to an improved novel structure for an outdoor sign or barrier which permits deflection, without damage, of the sign or barrier by wind forces and the like.

There is often need along vehicle roadways and pedestrian pathways for signs and barriers to provide information and mark off limits. Frequently, the need is temporary and, thus, it is very advantageous to have mountings for such signs and barriers which may be readily assembled and disassembled; yet which will not be moved, disturbed, or overturned by wind and/or the weight of rain or snow, or by air currents generated by the movement of vehicles. Also, to some extent, it is advantageous that such signs and barriers be temporarily deflectable by a direct contact of vehicles and pedestrians and the like without permanent damage and that such signs can be adjusted back to the vertical when positioned on inclines or on uneven surfaces.

There have been a number of structures devised to permit signs and posters to be temporarily deflected by wind forces. One such structure is shown in the present assignee's copending case, Ser. No. 594,879, filed Mar. 29, 1984, wherein that upright mast is secured to the horizontal shaft which passes through the mast, and one end of the resilient means is attached through a collar to the outside of the mast and the other end of the resilient means is firmly secured to the base mounting. A structure is disclosed in U.S. Pat. No. 4,364,435 wherein a sign panel is pivotally mounted at its two sides close to the center of its load wherein there would be the least amount of force applied to its springs. A bar stool structure is disclosed in U.S. Pat. No. 623,008 which has nothing to do with a sign and has one spring holding tension against one spring. A structure is shown in French Pat. No. 1,181,967 wherein an essentially single mast signpost is supported on a pair of resilient and foldable base members. Two additional structures are shown in U.S. Pat. No. 3,662,482 where a poster board is supported on two upright members: in one embodiment, the uprights are in turn supported on a torsion bar; and in the other embodiment a pair of flexible compression springs are substituted for the upright members. Also, U.S. Pat. No. 4,309,836 shows an adjustable flexible mast, for holding a sign, extending upwardly from a support frame.

However, except for the present assignee's apparatus in co-pending Ser. No. 594,879, the prior structures have involved resilient members which must be able to react in each of two opposite directions thereby tending to overwork the resilient members and increase the likelihood of loss through fatigue or overextension. Also, the prior structures do not provide for adjustment of the resilient members to allow compensation against mild prevailing wind forces or sloping terrain whereby the mast and sign may be adjusted to be upright in the best visible posture. That is to say, the prior art devices will be deflected to some extent by any given wind force and, therefore, if there is a constant breeze, the sign will be constantly deflected with loss of some visibility.

The present invention is an unexpected improvement over the prior art whereby in applicants' deflectable mounting, the entire load or pressures on the mast is applied to a supporting means, such as a fender, which transfers and distributes these forces uniformly over the effected resilient means, such as a spring, riding on a shaft, such as a hollow tube with end sides riding on an axle.

OBJECTS AND SUMMARY OF THE INVENTION

Accordingly, it is an object of the present invention to provide an improved deflectable mounting for an upright mast for supporting a sign or barrier or the like wherein two separate abutting resilient means are provided for resisting deflection of the mast in respective opposite directions.

It is another object of the present invention to provide an improved deflectable mounting for an upright mast for signs and barriers and the like, wherein there is an adjustment to maintain the mast vertical against a prevailing deflective force.

It is still another object of the present invention to provide an improved deflectable mounting for an upright mast for signs and barriers and the like, wherein two separate abutting resilient members are provided to resist deflective forces in opposite directions and the outer ends of the resilient members are adjustably mounted so as to disengage through a portion of deflection in a direction opposite to that which each resilient member is intended to resist.

The present invention generally comprises a single mast intended for a vertical posture affixed to a supporting means pivotally mounted upon a mounting base and wherein two spring members abutting one another end to end are concentric with a shaft whereby the abutting spring ends extend upwardly into a socket in the bottom of said mast through an opening in said supporting means and the outer ends of the two springs extend downwardly through openings in a shelf structure so that one spring resists pivoting of the mast principally in one direction and the other spring resists pivoting of the mast principally in a direction opposite thereto.

BRIEF DESCRIPTION OF THE DRAWINGS

Further objects and advantages will become apparent upon reading the following detailed specification in conjunction with the drawings, wherein.

DETAILED DESCRIPTION

Figure 1:
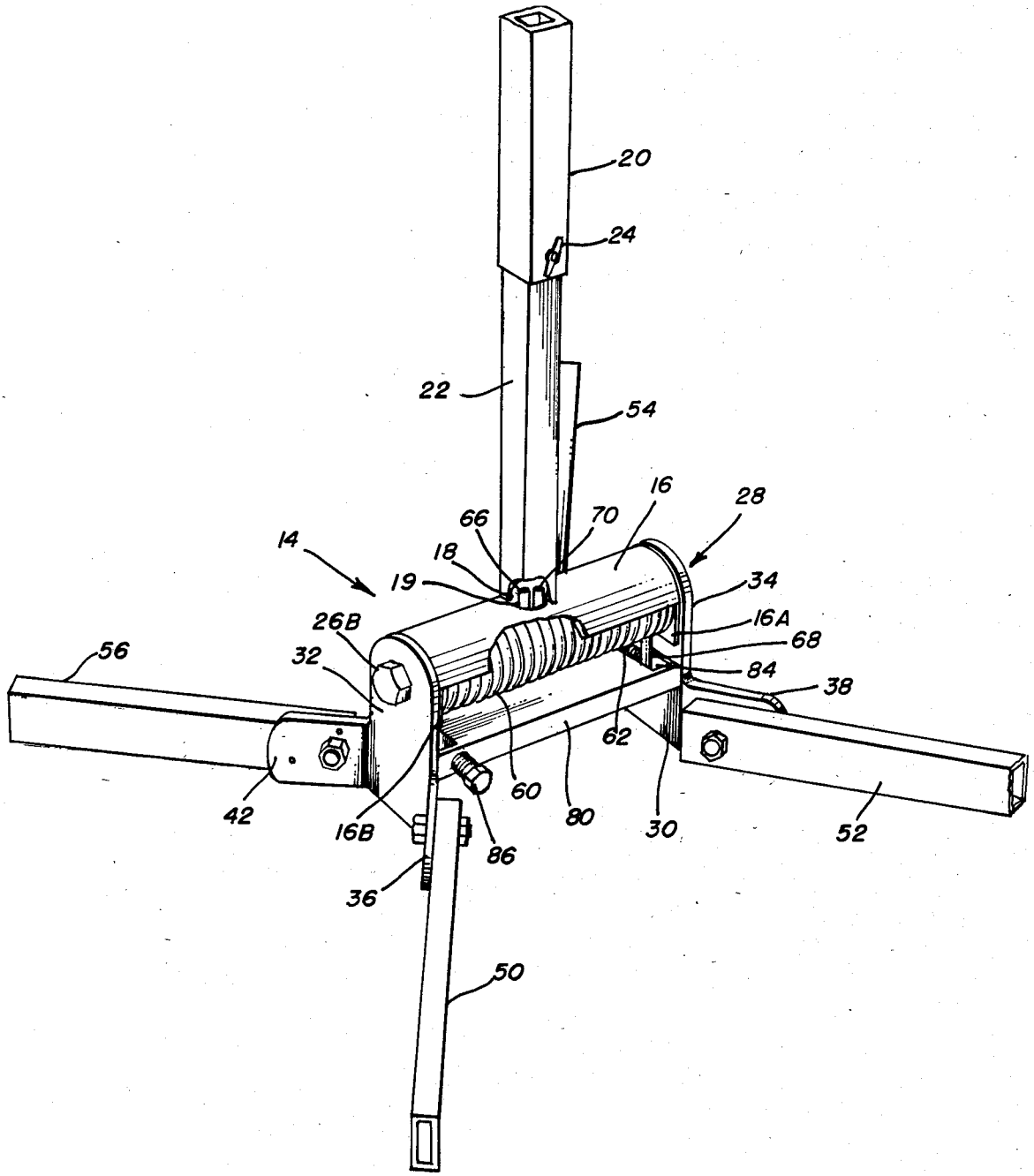
FIG. 1 is a perspective view of a preferred embodiment of the present invention.
Figure 2:
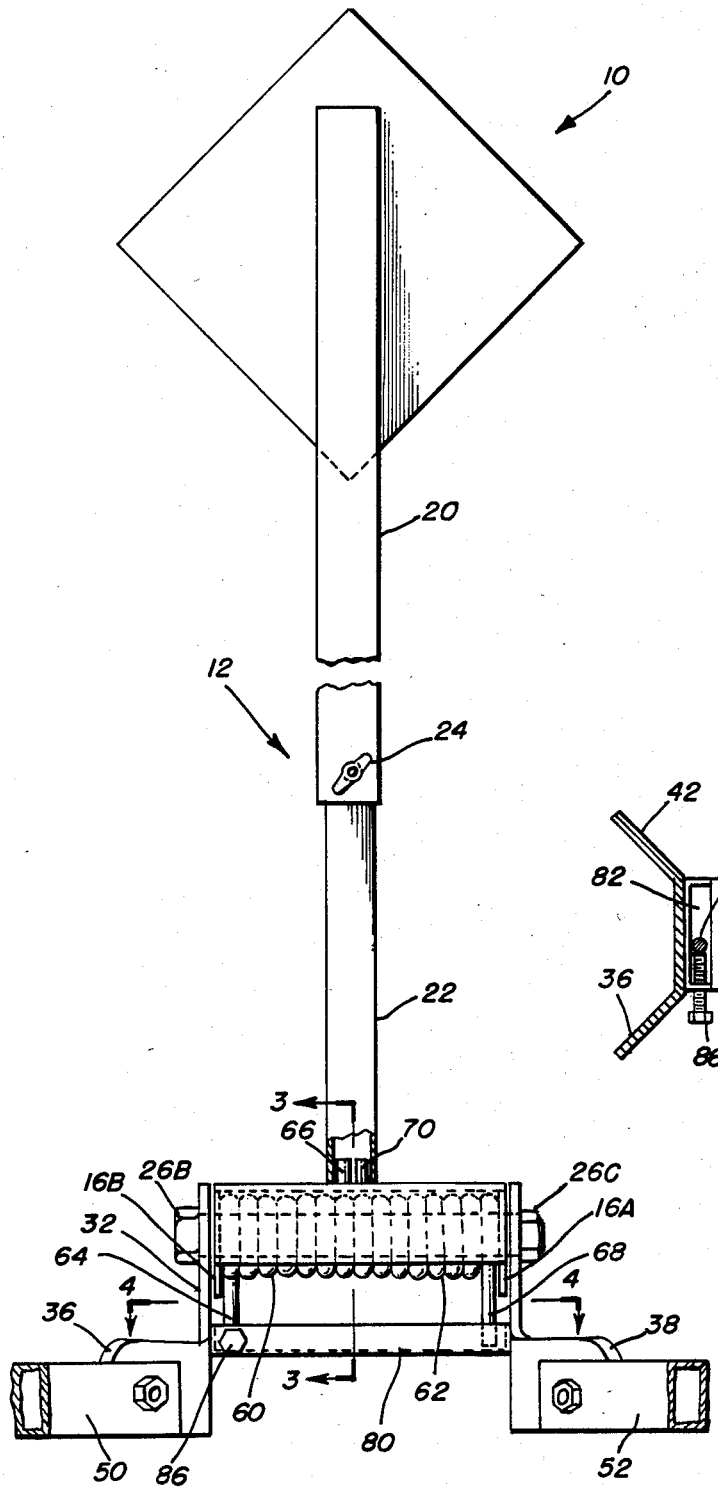
FIG. 2 is a front elevation of a portion of the apparatus shown in FIG. 1.

The preferred embodiment of the invention shown in the figures comprises a visible member generally 10, such as a sign or barrier bar or the like, which is vertially supported upon a mounting base, preferably a foldable mounting base generally 28 (as seen in FIG. 1 and FIG. 2). It is desirable that the vertical height of the mast 12 be adjustable which can be accomplished by providing an upper mast portion 20 telescopically fitted to a lower mast portion 22 and a securing device 24, such as a set screw or the like, for releasably fastening the two portions 20, 22 together.

Figure 3:
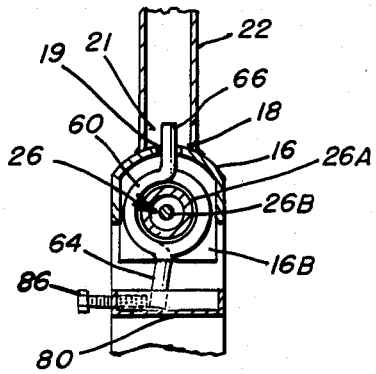
FIG. 3 is a partial end view of the apparatus taken at line 3—3 in FIG. 2.

According to the present invention, the mast 22 (as seen in FIG. 1) is affixed such as by welding 18, to supporting means, such as a semi-cylindrically or an arcuate shaped fender 16, which is mounted upon the mounting base generally 28 by a pivotable means, preferably a horizontal shaft 26 (as seen in FIG. 3), such as a hollow tube with end sides 26A seated on an axle such as a bolt 26B affixed with a nut 26C at the end of said mounting stand generally 28 (as seen in FIG. 2). The fender 16 comprises a semi-cylindrically or an arcuate section having two opposite situated end sides 16A and 16B which sides are pivotally mounted on the shaft 26 and axle such as the bolt 26B inwardly of said mounting stand generally 28. The mast 22 is firmly secured centrally to the fender 16 such as by welding 18 or other means. It will be seen in the drawings that the mounting stand 28 comprises a lower frame 30 having two oppositely situated upright members 32, 34 in the upper ends of which the shaft 26 and axle such as the bolt 26B are seated. The mounting base 28 also has multiple (preferably four) leg flanges 36, 38, 40 and 42 extending from the corners of the lower crosspiece 30; and an equal number of foldable and extendable legs 50, 52, 54 and 56 are pivotally mounted thereon.

First and second resilient means are located below the mast 22 and the supporting means such as the fender 16 mounted on the mounting base 28 to urge the mast 22 in an upright position. These are preferably coil springs 60, 62 (as seen in FIG. 2) which are concentrically placed over the horizontal shaft 26 and are abutting end to end directly below the mast 22. The fender 16 is partially concentric to said springs 60, 62. Coil springs 60, 62 are substantially identical in dimensions, strength and direction of wind.

It is understood that the coil springs 60, 62 of the preferred embodiment are of the type formed from elastic steel spring wire helically wound in cylindrical form and having outwardly extended radial ends for applying compression and tension forces to the helical coils. It is well known that in this type of spring tension forces, which tend to tighten the coils, are efficiently resisted by the spring and the ends will withstand a large degree of twist and tensioning movement without causing damage to the spring coils. However, these springs do not resist compressive forces, which tend to open the coils, efficiently and relatively small twisting movement of the ends in compression will cause permanent damage and loss of spring resiliency.

Figure 4:
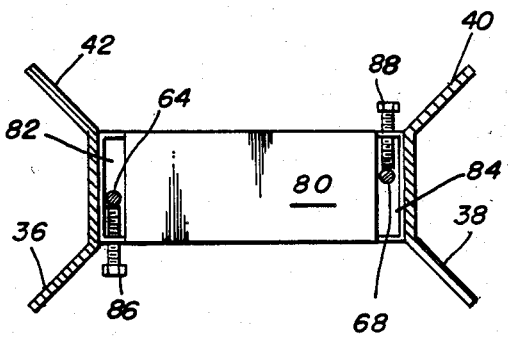
FIG. 4 is a partial plan view, in section, taken at line 4—4 in FIG. 2.

In the present invention, the coil spring 60 has two opposite end strands 64, 66 and coil spring 62 similarly has end strands 68, 70. The abutting spring end strands 66 and 70 extend upwardly through an opening 19 in fender 16 and into the bottom of the mast 22 where they fit within the socket 21. The respective opposite end strands 64, 68 of springs 60, 62 are loosely received through the indented side openings 82, 84 at opposite ends of the shelf 80 that bridges the mounting stand 28 a short distance below the horizontal shaft 26 and springs 60, 62. The shelf 80 is firmly secured to the inner sides of upright members 32 and 34 of the mounting stand 28 such as by welding or the like. The outer spring end strands 64 and 68 descend into the indented outer side openings 82, 84 of the shelf structure 80 below the horizontal shaft 26 and descend below the floor of the shelf 80 within the openings 82, 84 wherein the respective end strands 64, 68 may move in planes perpendicular to the shaft 26. In this way, the mast 22 may be pivoted several degrees on the supporting means, such as the fender 16 which pivots freely on shaft 26 in a given direction before the respective end strand 64 or 68 becomes engaged by the adjustment bolts 86 or 88 in a compressive action to resist further deflection or pivoting; but at the same movement the other respective end strand 64 or 68 will be immediately engaged by the other adjustable bolt 86 or 88 in a tension action to resist further deflection. As seen in FIG. 4, adjustment bolts 86, 88 are preferably threaded through the opposite side ends of the shelf 80 in line with the respective end strands 64, 68 whereby the degree of free pivoting deflection of the mast 22 may be adjusted and the spring end strand engaged.

As may be best seen in FIGS. 2 and 3, the spring end strands 64, 68 normally extend downwardly from slightly off center of the spring and closer to its adjustment bolt in a near vertical direction when not under stress. Accordingly, by proper adjustment of each of the adjustment bolts 86,88, the mast 22 may be held vertical by the respective end strands 64, 68 of the springs 60, 62. However, by then tightening one and loosening the other of bolts 86, 88, the mast 22 and fender 16 may be pivoted slightly on shaft 26 in either of two directions. Such adjustment may be made while still providing several degrees of play between the respective end strands 64, 68 within the openings 82, 84. Thus, when the mast 22 is adjusted either vertically or slightly to either side thereof, the load or pressures applied against the mast 22 in one direction will be resisted immediately by the tension on the fender 16 which is transferred and distributed uniformly to one of the springs 60, 62 riding on the shaft 26 and the other spring will not become compressed until the pressure has been sufficient to tension the fender 16 and the first spring several additional degrees in pivoting movement. Reverse pressures in the opposite direction will result in the opposite of the fender 16 and springs 60, 62 being tensioned immediately (after tension in the first spring is released) and several degrees pivoted movement may occur before the first spring is compressed. It is seen that it is the fender 16 that actually operates the springs 60, 62 by transferring and distributing the forces uniformly over the springs 60, 62 riding on the shaft 26.

In this way, the mast 22 mounted on the fender 16 may be pre-adjusted to stand substantially vertical against a prevailing force, such as wind or on an incline which would otherwise constantly deflect the mast and any sign or visible display it carries.

While the preferred embodiment illustrated utilizes coil springs in the form of cylinders of helically wound wire, it would also be possible to utilize spiral wound springs comprising elastic steel wire wound in a single plane (similar to a watch spring).

It will be apparent to those skilled in the art that still further modifications and changes may be made without departing from the scope of the invention which is defined in the following claims.

What is claimed is:

1. An improved deflectable mounting for an upright mast, the mounting comprising:

(a) a mast affixed substantially perpendicularly to a supporting means;

(b) a mounting base for supporting the supporting means and the mast;

(c) a pivotable means connected to the mounting base and supporting means for deflecting the mast and supporting means in two opposite directions;

(d) a first resilient means, mounted about the pivotable means, for resisting deflection of the mast and supporting means principally in a first direction;

(e) a second resilient means, mounted about the pivotable means, for resisting deflection of the mast and supporting means principally in a second direction; and (f) an adjustable mounting means for adjustably securing the first and second resilient means to the mounting base and the mast and/or the supporting means so that the mast may be adjusted to a certain position against a deflecting force, wherein the adjustable mounting means provides a disconnection between the first and second resilient means during a portion of deflection in a direction opposite to the respective principal direction.

2. The apparatus of claim 1, wherein the pivotable means is a shaft which extends beneath the supporting means and is seated in the mounting base.

3. The apparatus of claim 2, wherein both the first and second resilient means are wound springs that are mounted so that they may be alternately tensioned by deflection of the mast and supporting means in the two opposite directions, respectively.

4. The apparatus of claim 3 wherein the springs are helically wound and concentrically mounted on the shaft, a first spring being to one side of the shaft and a second spring being to the opposite side, the two springs abutting one another end to end directly beneath the mast.

5. The apparatus of claim 4, wherein the adjustable mounting means loosely receives an outer end strand of each spring so that a portion of a deflection of the mast may occur without compressing or tensioning each spring.

6. The apparatus of claim 5, wherein the adjustable means includes movable members to reduce or increase the amount of deflection by which the said springs will not be compressed or tensioned.

7. The apparatus of claim 6, wherein the mounting base has a shelf bridging the base and and has indented side openings at both outer ends to receive the outer spring strands descending through the indented side openings.

8. The apparatus of claim 7, wherein adjustable bolts extend through the opposite sides of the shelf into the indented side openings.

9. The apparatus of claim 8 wherein each of the springs has upwardly extending inner end strands which pass through an opening in the supporting means into a socket opening at the bottom of the mast.

10. The apparatus according to claim 9, wherein the supporting means comprises a semi-cylindrically or arcuate shaped fender that operates the springs and which is partially concentric to the springs and has two opposite side ends through which the shaft extends.

11. The apparatus of claim 10 having an upper mast attached to said mast.

12. The apparatus of claim 11 having a panel attached to the upper mast.

13. The apparatus of claim 1, wherein both the first and second resilient means are wound springs that are mounted so that they may be alternately tensioned by deflection of the said mast and supporting means in the two opposite directions respectively.

14. An improved deflectable mounting for an upright mast, said mounting comprising:

a normally vertical mast member firmly affixed to a supporting means having an arcuate shaped horizontal fender member with opposing sides extending downward;

a mounting base for supporting said mast member and supporting means, said mounting base having a plurality of foldable legs extendable therefrom to stabilize the deflectable mounting;

a normally horizontal pivotable shaft extending through the sides of said supporting means and through said mounting base whereby said mast member and supporting means may deflect freely in two opposite directions;

a shelf bridging said mounting base, below said shaft, said shelf having first and second indented side openings at both outer ends thereof;

at least one bolt adjustably extending through opposite front end sides of said shelf into each of said indented side openings;

a first wound spring mounted about said shaft, said spring having an outer end strand and inner end strand, the outer end strand of said spring extending downwardly through said first indented side opening and the inner end strand of said spring extending upwardly into a socket opening in said fender member and said mast member;

a second wound spring mounted about said shaft, said spring having an outer end strand and an inner end strand, the outer end strand of said spring extending downwardly through said second indented side opening and the inner end of said spring extending upwardly into a socket opening in said fender member and said mast member;

wherein deflection of said mast in one direction will tension said first spring, and deflection of said mast in an opposite direction will tension said second spring, and wherein the outer end strands of said springs received within the first and second indented side openings will be alternately disengaged for a portion of mast deflection when the tension is released and before each respective spring is compressed; and wherein said arcuate shaped horizontal fender member is partially concentric to said springs and said fender member operates the springs.

15. The apparatus of claim 14 having an upper mast attached to said mast.

16. The apparatus of claim 15 having a panel attached to the upper mast.

17. An improved deflectable mounting for an upright mast, the mounting comprising:

(a) a mast affixed substantially perpendicular to a support;

(b) a mounting base supporting the support and the mast;

(c) a pivotable shaft extending substantially parallel to the support and connecting the support to the mounting base;

(d) a first wound spring mounted about one side of the shaft and having an outer end strand and an inner end strand;

(e) a second wound spring mounted about the opposite side of said shaft, the second spring having an outer end strand and an inner end strand, the first and second springs abutting one another end to end directly beneath said mast, wherein the inner end strands fit into the bottom of said mast through an opening in the support; and (f) an adjustable mounting means extending through the mounting base to engage the outer end strand of each wound spring to allow for biasing adjustment of the mast.

18. The apparatus of claim 17 having an upper mast attached to said mast.

19. The apparatus of claim 13 having a panel attached to the upper mast.

* * * * *

UNITED STATES PATENT AND TRADEMARK OFFICE

CERTIFICATE OF CORRECTION

PATENT NO. : 4,886,232

DATED : December 12, 1989

INVENTOR(S) : DICKE et al.

It is certified that error appears in the above-identified patent and that said Letters Patent is hereby corrected as shown below:

Claim 19, line 1 (col. 8, line 5)

"claim 13" should read --claim 18--

Signed and Sealed this

Twentieth Day of August, 1991

*Attest:*

HARRY F. MANBECK, JR.

*Attesting Officer*

*Commissioner of Patents and Trademarks*